US012409988B2

(12) United States Patent
Melendez

(10) Patent No.: US 12,409,988 B2
(45) Date of Patent: Sep. 9, 2025

(54) CAN PROTECTOR AND CAP

(71) Applicant: David Melendez, Kihei, HI (US)

(72) Inventor: David Melendez, Kihei, HI (US)

( * ) Notice: Subject to any disclaimer, the term of this patent is extended or adjusted under 35 U.S.C. 154(b) by 0 days.

(21) Appl. No.: 18/161,636

(22) Filed: Jan. 30, 2023

(65) Prior Publication Data

US 2023/0242309 A1 Aug. 3, 2023

Related U.S. Application Data

(60) Provisional application No. 63/305,201, filed on Jan. 31, 2022.

(51) Int. Cl.
*B65D 51/00* (2006.01)

(52) U.S. Cl.
CPC .... *B65D 51/007* (2013.01); *B65D 2517/0098* (2013.01)

(58) Field of Classification Search
CPC ..... B65D 51/007; B65D 51/20; B65D 2251/0018; B65D 2251/0071; B65D 17/4012; B65D 2517/0041; B65D 2517/0098; A47G 19/22
USPC ..... 220/287
See application file for complete search history.

(56) References Cited

U.S. PATENT DOCUMENTS 4,927,048 A * 5/1990 Howard ..... B65D 41/52 220/279
5,078,296 A * 1/1992 Amidzich ..... B65D 55/16 220/838
5,119,955 A * 6/1992 Granofsky ..... B65D 17/506 220/254.2
5,139,163 A * 8/1992 Diaz ..... B65D 21/0219 206/509
5,934,495 A * 8/1999 Chiodo ..... B65D 25/36 220/257.2
6,015,059 A * 1/2000 Takayama ..... B65D 17/4012 220/269
7,318,534 B2 * 1/2008 Turvey ..... B65D 41/22 220/796
8,336,730 B2 * 12/2012 Pontes ..... B65D 51/20 206/508
10,220,984 B1 * 3/2019 Vigoureux ..... B65D 41/22
2004/0000551 A1 * 1/2004 Flink ..... B65D 47/06 220/717
2006/0060584 A1 * 3/2006 Onoda ..... B65D 51/20 220/276

(Continued)

OTHER PUBLICATIONS

4IMPRINT USA, "Universal Soda Lid," URL: https://www.4imprint.com/product/1269/Universal-Soda-Lid?mkid=3dsaALP&s_kwcid=AL!4167!10!73598808984599!2325398373324834&utm_source=bing&ut m_medium=msppc&utm_term=%2Fproduct%2F&utm_campaign=DSA-ALP%20Bing&ef_id=33567930651b1bb5b2e41f442ad9909e:G:s&msclkid=33567930651b1bb5b2e41f442ad9909e&utm_content=All%20Products, retrieved from internet Jun. 20, 2024 (4 pages).

(Continued)

*Primary Examiner* — James N Smalley
(74) *Attorney, Agent, or Firm* — FOLEY & LARDNER LLP

(57) ABSTRACT

Provided herein is a re-usable device that would allow for the export of, or consumption of liquid without having to remove the device from the can such as the aluminum beverage can and that would also seal the liquid inside a beverage can. A water-resistant or water-proof, insect-proof, dirt-proof synthetic cap is provided that is to be attached to the lip area of the open mouth of can or other open mouth container, such as metal, plastic or an aluminum beverage can.

19 Claims, 8 Drawing Sheets

(56) References Cited

U.S. PATENT DOCUMENTS

| | | | | |
|---|---|---|---|---|
| 2007/0090081 | A1* | 4/2007 | Briscoe | A47G 19/2272 220/717 |
| 2012/0145727 | A1* | 6/2012 | Gammage | A47G 19/2211 220/709 |
| 2013/0043259 | A1* | 2/2013 | Gonzalez Sanchez | B65D 51/007 220/694 |
| 2014/0110409 | A1* | 4/2014 | Gindi | B65D 17/4012 220/361 |
| 2019/0084732 | A1* | 3/2019 | Lamberto | B65D 1/165 |
| 2020/0038531 | A1* | 2/2020 | McGrade | C11D 3/48 |
| 2022/0127045 | A1* | 4/2022 | VanBuren | B65D 25/36 |
| 2022/0306443 | A1* | 9/2022 | Ravazzoni | B67B 5/034 |

OTHER PUBLICATIONS

Smarter-Seal, "12-Pack Soda/Beverage Can Lids, Clear Color," URL: https://smarter-seal.com/products/smarter-seal-soda-or-beverage-can-lid-cover-or-protector-12-pack-clear, retrieved from internet Jun. 20, 2024 (1 page).

* cited by examiner

CAN PROTECTOR AND CAP

CROSS-REFERENCE TO RELATED APPLICATION

This application claims priority under 35 U.S.C. § 119(e) to U.S. Provisional Application No. 63/305,201, filed Jan. 31, 2022, the content of which is hereby incorporated by reference in its entirely into this disclosure.

BACKGROUND

Current beverage caps are made of plastic to provide a cap or lid for a beverage that cannot be removed from the top area and which are easily misplaced. These products provided more of a cap or lid than a sealant. These products are neither water-proof nor water-resistant, nor are they intended for that purpose. Thus, a need exists in the art for a re-usable protectant for liquid inside an open mouth container such as an aluminum beverage can from outside contaminates.

This disclosure satisfies this need and provides related advantages as well.

SUMMARY OF THE DISCLOSURE

Provided herein is a re-usable device that would allow for the export of, or consumption of liquid from a closed container having an opening for accesses to the liquid without having to remove the device from the can such as the aluminum beverage can and that would also seal the liquid inside a beverage can when desired. One improvement of the disclosed beverage cap of this disclosure is its thin attachable inner band that wraps around the can or box that maintains the cap or lid from being removed or pulled off the can or box after a drink or use. Thus, in one aspect, a water-proof or water-resistant, insect-proof, dirt-proof synthetic cap is provided that is to be attached to the lip area of the open mouth of the can or other open mouth container, such as metal, plastic or an aluminum beverage can or box. In one aspect, when attached to a beverage can or box, the cap is intended to be used for beverage consumption while retaining sanitation precautions and/or for the protection of liquid inside an aluminum beverage can from outside elements. In one aspect, the cap is comprised of a silicon rubber material.

BRIEF DESCRIPTION OF THE FIGURES

FIGS. 1A, 1C and 1D show the cap in an open position and FIGS. 1B, 1E and 1F show the cap on the can or box in a closed position.

FIG. 4A shows an embodiment without carbonation- or foam-reducing holes and FIG. 4B shows an embodiment with carbonation- or foam-reducing holes.

FIG. 12A is an underside view of the cap. FIGS. 12B to 12D show side views of the cap of this disclosure.

DETAILED DESCRIPTION OF THE DISCLOSURE

As shown in the figures, an embodiment of the present disclosure is directed to a beverage can or box cap or lid comprised of a re-usable cap or lid that is easily placed on the can or box and opened to gain access to the beverage. In one embodiment, the disclosure is directed to the lid or cap. In another embodiment, the disclosure is directed to beverage can or box and the re-usable cap or lid.

The term "about," as used herein when referring to a measurable value such as an dimension or proportion of an element is meant to encompass variations of 20%, 10%, 5%, 1%, 0.5%, or even 0.1% of the specified dimension or proportion.

Figure 1A:
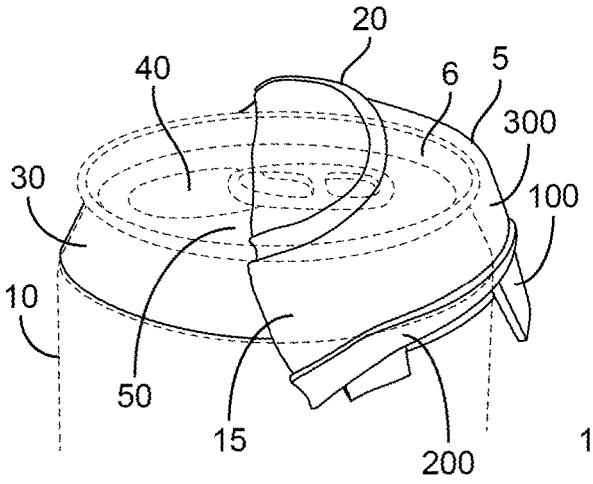
FIGS. 1A to 1F are transparent perspective views of a combination of the cap on a 12 ounce beverage can (FIGS. 1A to 1E) or box (FIG. 1F). The figures show embodiments of the cap on a 12 ounce beverage or box can as it is placed on the open surface of the can or box.
Figure 1B:
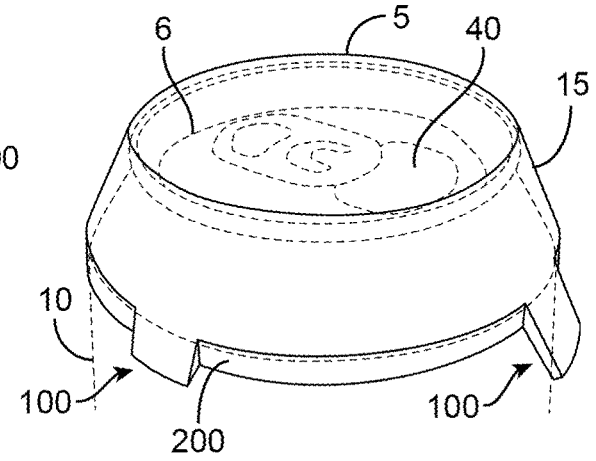
Figure 1C:
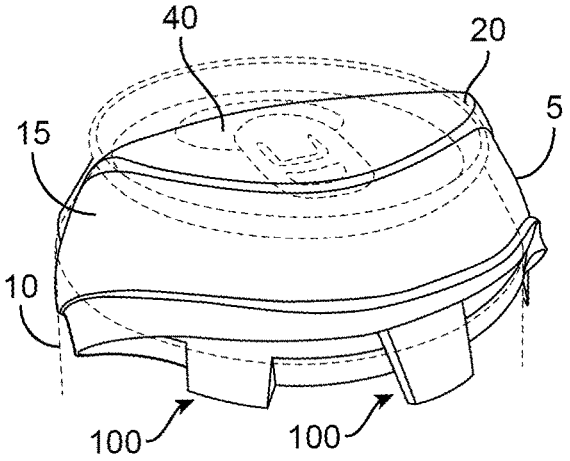
Figure 1D:
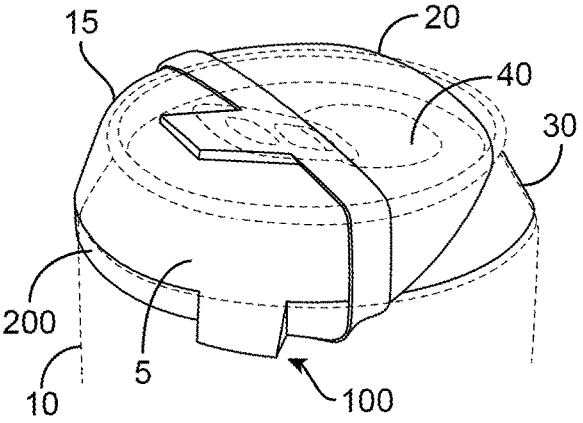
Figure 1E:
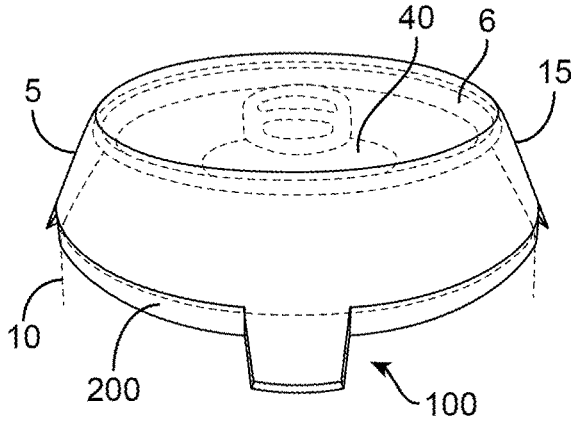
Figure 1F:
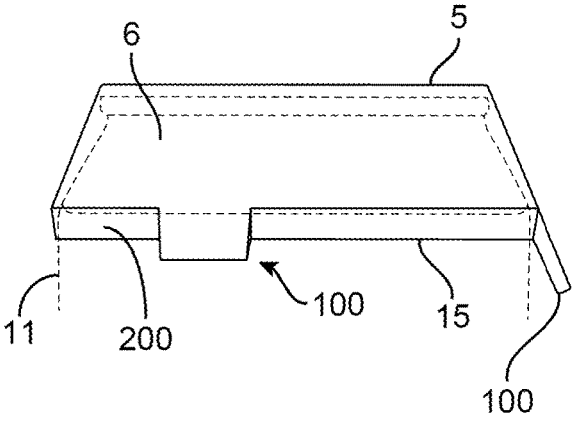
Figure 2:
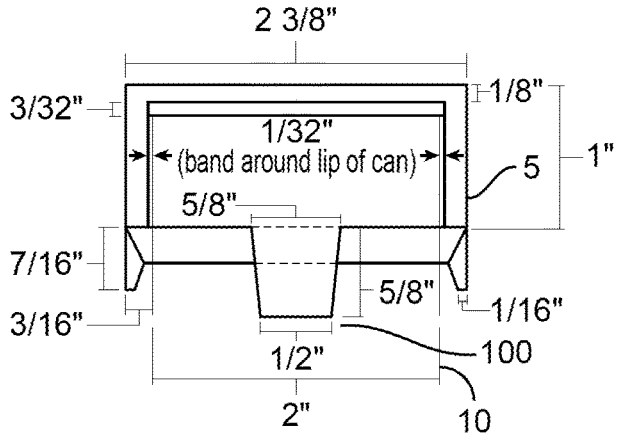
FIG. 2 shows a mock-up of a front view of an embodiment of a cap of this disclosure on a beverage can or box. Exemplary dimensions of the various elements are noted in the Figure.
Figure 3:
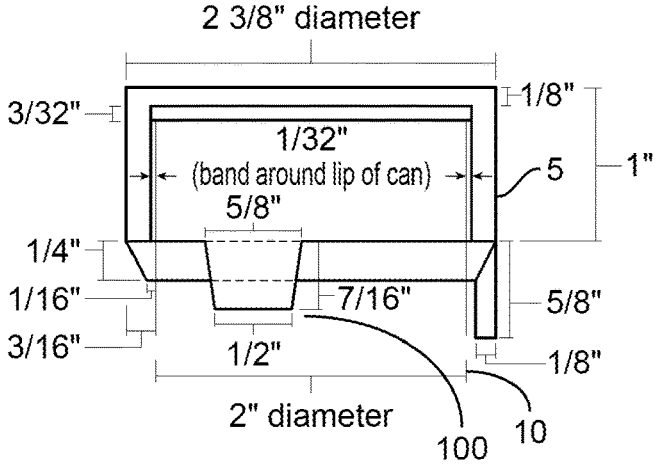
FIG. 3 shows a mock-up of side view of an embodiment of a cap of this disclosure on a beverage can or box. Exemplary dimensions of the various elements are noted in the Figure.
Figure 4A:
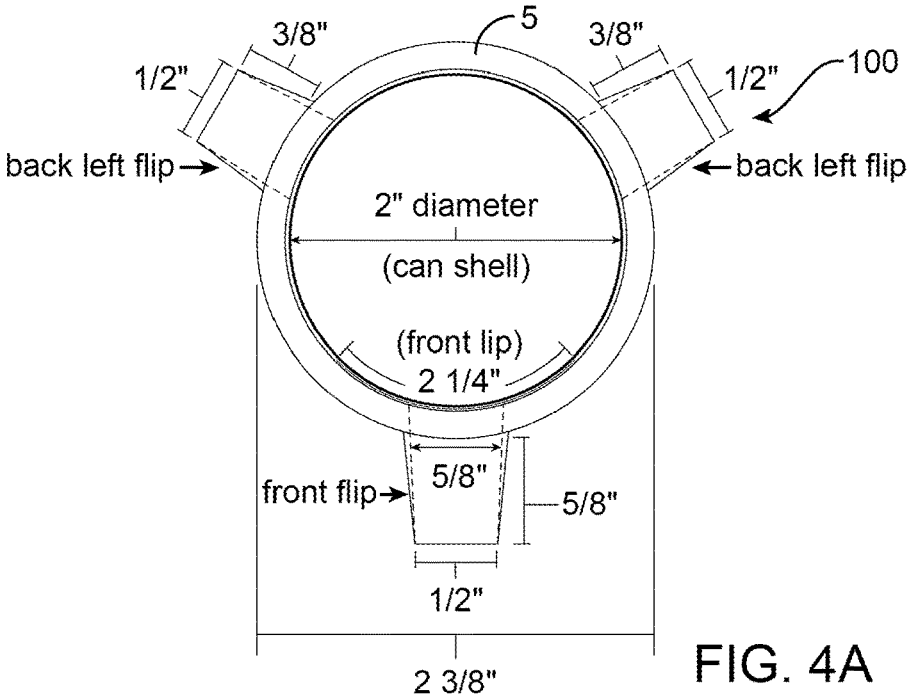
FIGS. 4A and 4B shows a mock-up of a top view of an embodiment of the cap of this disclosure on a beverage can.
Figure 4B:
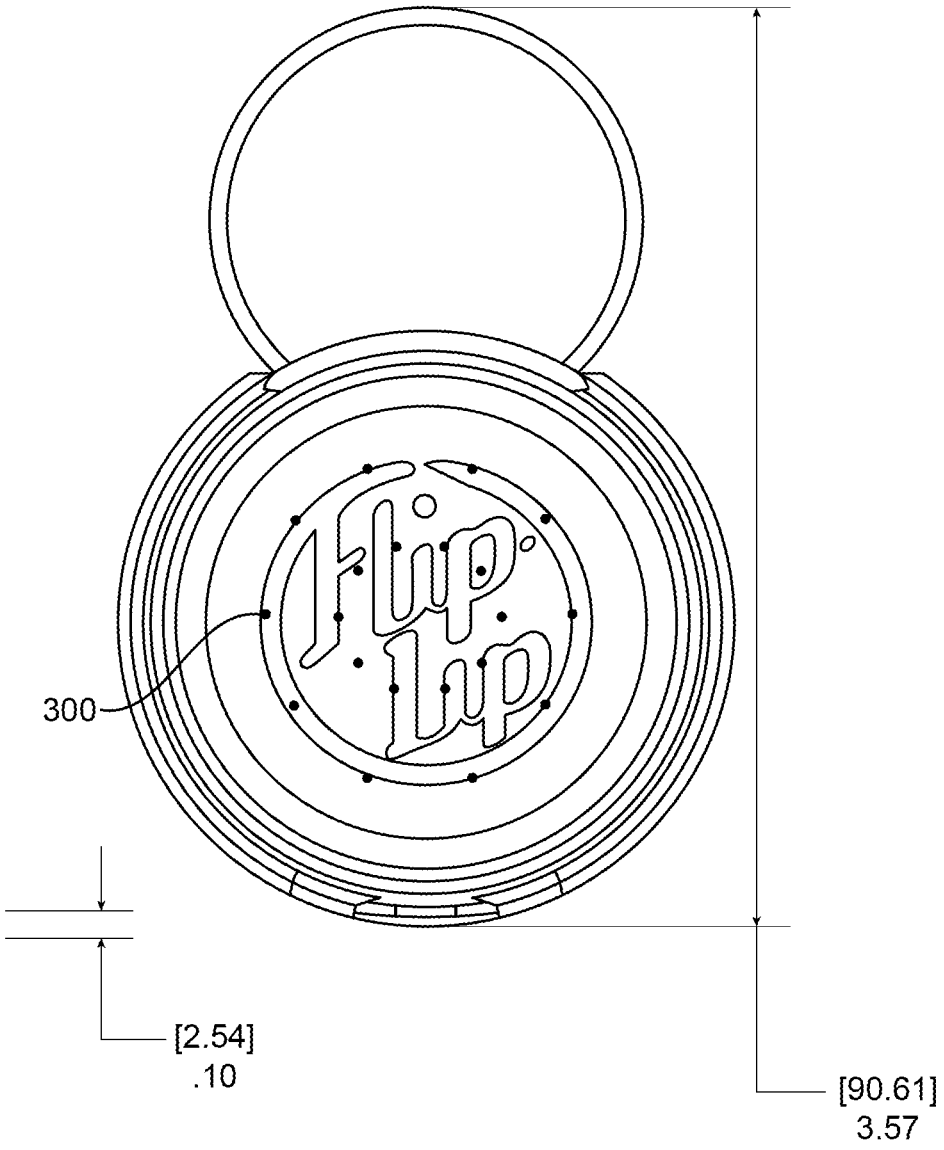
Figure 5:
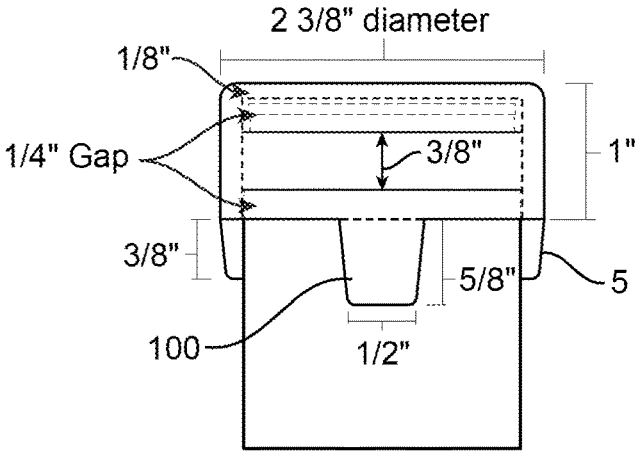
FIG. 5 shows a mock-up of a front view of an embodiment of the cap of this disclosure on a beverage can with suggested dimension of the elements of the cap. Exemplary dimensions of the various elements are noted in the Figure.
Figure 6:
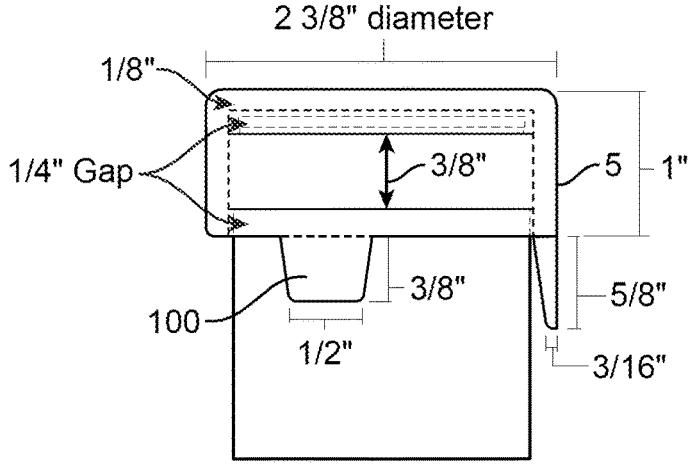
FIG. 6 shows a mock-up of a side view of an embodiment of the cap of this disclosure on a beverage can with suggested dimension of the elements of the cap. Exemplary proportions of the elements of the various elements are noted in the Figure.
Figure 7:
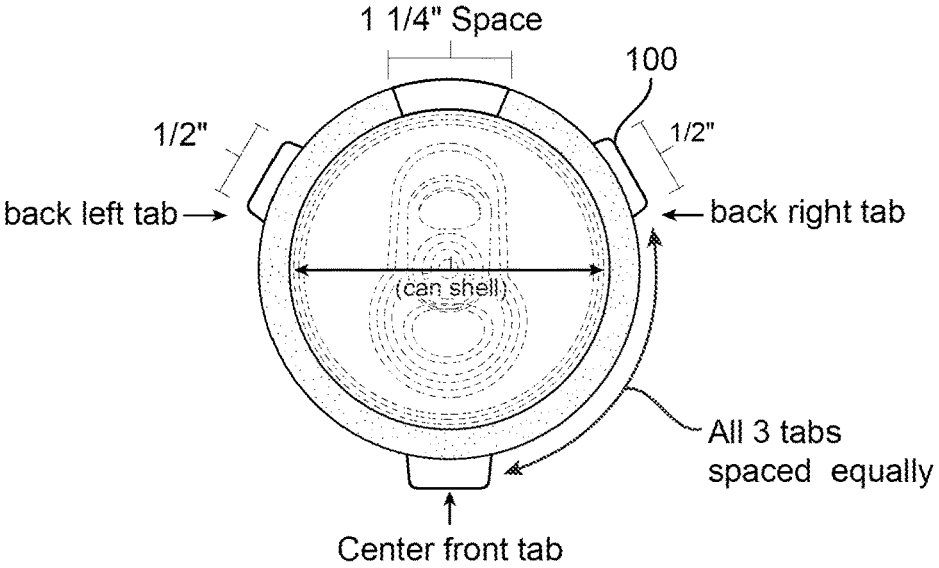
FIG. 7 shows an illustration of a top view of an embodiment of the cap of this disclosure on a beverage can with suggested dimension of the elements of the cap. For the purpose of illustration only, the floor is absent from this view to aid in visualizing how the band lays under the shell when the cap is shut and shows the meeting point for the inner support band and the outer band. When the cap is pulled back to access the beverage, the band or strap stays secure around the can or box.

As shown in FIGS. 1A to F, the cap 5 is place on the beverage can 10 (FIG. 1A to 1G) or box 11 (FIG. 1F). The cap 5 is placed on the top of the can is configured to engage the lip area 30 of the can or box. The cap or lid is comprised of a floor portion 6, the sidewall 15, the support band 200 and one or more tabs 100 joined to the sidewall 15 and support band 200 and contiguous to them. The one or more tabs 100 are configured to provide an anchor to affix the cap 5 on the beverage can 10 or box 11 and lift a portion of the cap 5 to allow access to the opening of the can or box 40 and the liquid or beverage contained therein. FIGS. 1A, C and D show an embodiment wherein the cap 5 is placed on a can 10. FIG. 1F shows an embodiment wherein the cap 5 is placed on a box 11. See also FIGS. 5 to 7. The floor 6 of the cap 5 covers the top of the can 50 which includes the access portal 40 to the can's contents. In one aspect, the cap 5 is perforated with one or more small (about 1/32; or about 1/16, or about 2/16; or about 3/16; or about 4/16, or about 1.0 mm, or about 1.5 mm or about 2.0 mm or above, up to about 0.5 cm) holes (300) (see FIG. 4B), which may be the same or different size or shape. There can be any suitable number of perforations, e.g., at least 5, or at least 15, or at least 20 perforations in the cap. See FIG. 4B. The sidewall 15 and support band 200 of the cap 5 are substantially perpendicular to the floor 6 but configured to encase the can when on it creating a closed container. The sidewall 15 and support band 200 are configured to engage the lip area 30 of the can. Joined to and contiguous with the sidewall 15 and support band 200 is one or more tabs 100 that serve to assist the user with placing the cap or lid 5 of the top 50 of the can or box. Using the tabs 100, the user positions the cap 5 to encompass the top 50 of the can 10 or box 11 and provides pressure to the bottom of the can 10 or box 11 such that sidewall 15 and support band 200 cover and engage the lip area 30 of the can 10 or box 11 holding the floor 6 of the cap 5 to the top 50 of the can 10 or box 11. To gain access to the can 10 or box 11 contents, the user lifts a portion of the sidewall 15 from the lip area 30, with or without use of a tab 100 to flip a portion of the floor 6 of the cap 5 to gain access to the can or box opening 40. The flipped portion 20 of the cap 5 is shown in the Figures.

FIGS. 1B, E and F show the lid when it is in the closed position creating a seal on the beverage can or box. As shown in these figures, the floor 6 of the cap or lid 5 is substantially parallel to the top of the can 10 or box 11 when in the closed position. The sidewall 15 and support band 200 engage the lip area 30 to hold the cap or lid 5 to the can 10 or box 11. The one or more tabs 100 (which can be the same or different dimensions) are joined to and contiguous with the sidewall 15 and support band 200 of the cap or lid 5.

Figure 13:
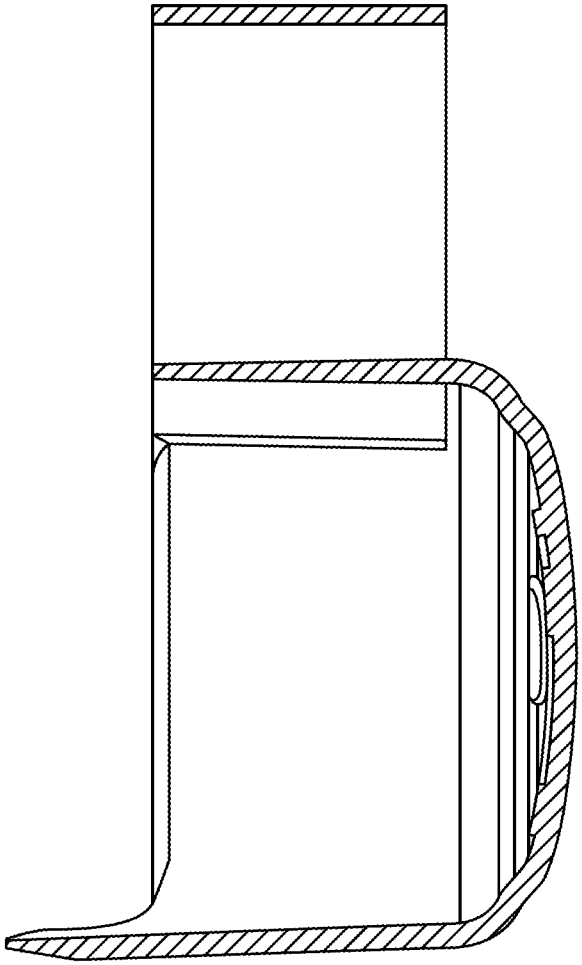
FIG. 13 shows an embodiment of the cap of this disclosure, shown inside-out.

FIG. 13 shows an alternative embodiment of the cap manufactured for use on a cal. In this embodiment, the cap 5 shows the inside sidewall 15 that wraps around the can, has larger dimensions, adding about from 0.5 inch to about 1.0 inch from prior embodiments (see e.g., FIGS. 2, 3, 6 and 7). In addition, in this embodiment only one central tab 100 is provided to assist with affixing the cap to the can or box.

FIGS. 2 through 7 are mock-ups of the cap 5 when placed on a can 10, providing dimensions or proportions of the floor 6, sidewall 15 and the one or more tabs 100.

Figure 8:
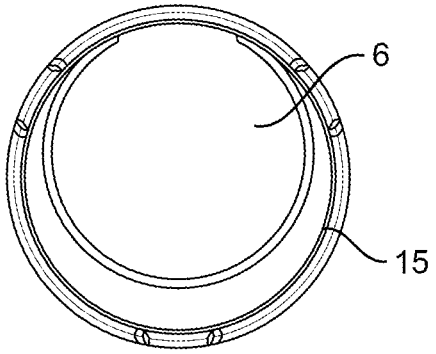
FIG. 8 shows a top view of an embodiment of the cap of this disclosure.
Figure 9:
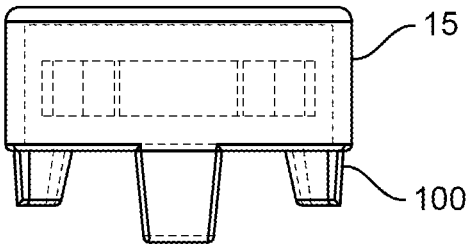
FIG. 9 shows a first top view of an embodiment of the cap of this disclosure.
Figure 10:
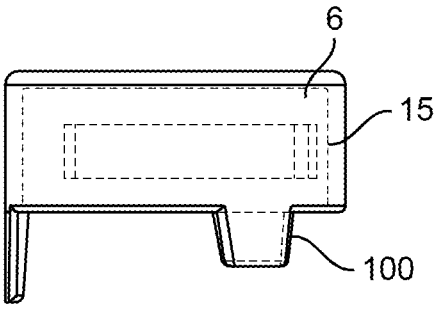
FIG. 10 shows a second top view of an embodiment of the cap of this disclosure.

FIGS. 8 to 10 show the dimensions or proportions of the external elements of the cap when not positioned on a can or box. FIG. 8 is the top view, FIGS. 9 and 10 are the side views showing the tabs of varying dimensions in communication with the sidewall.

Figure 11A:
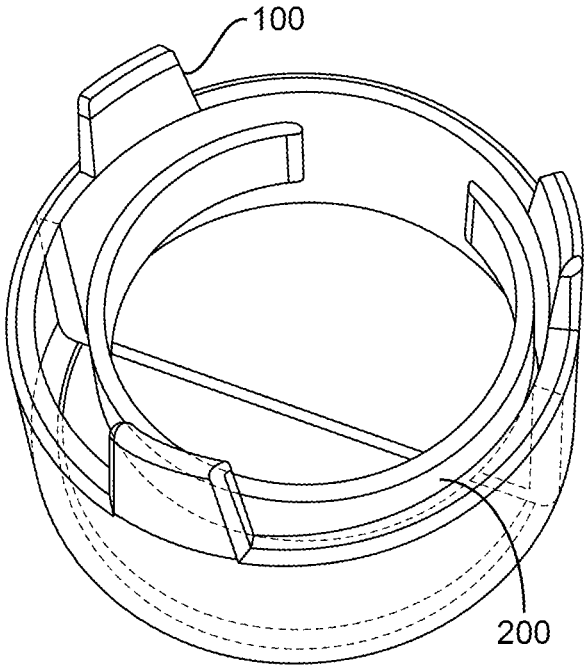
FIGS. 11A and 11B show cut outs of the cap of this disclosure.
Figure 11B:
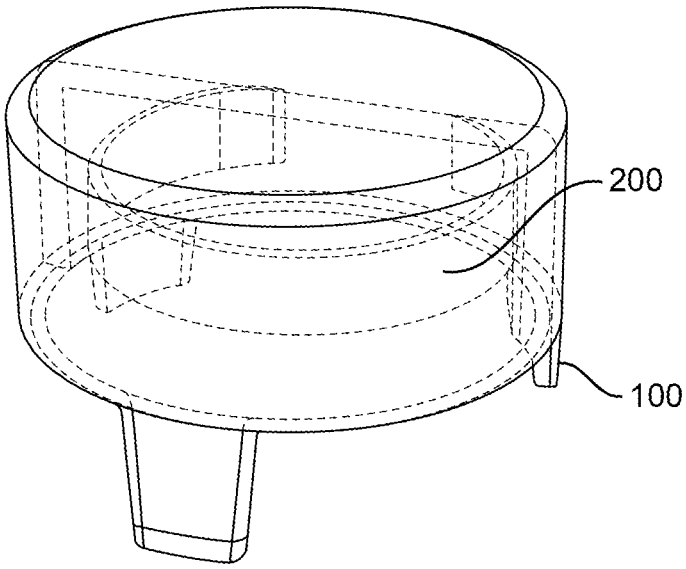
Figure 12A:
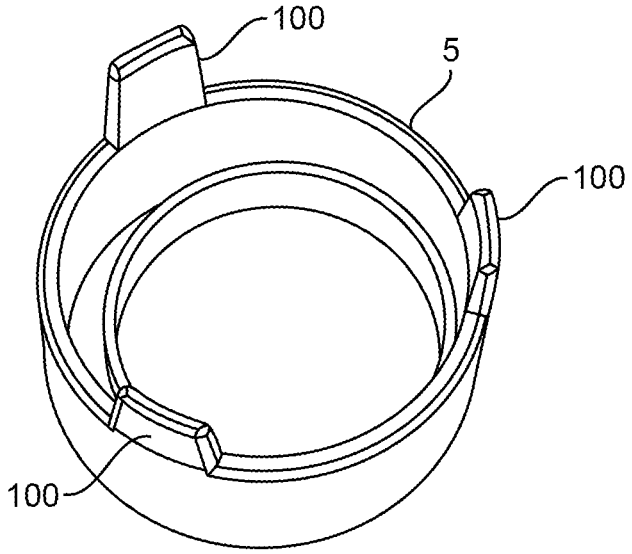
FIGS. 12A to 12D show various views of cap of this disclosure.
Figure 12B:
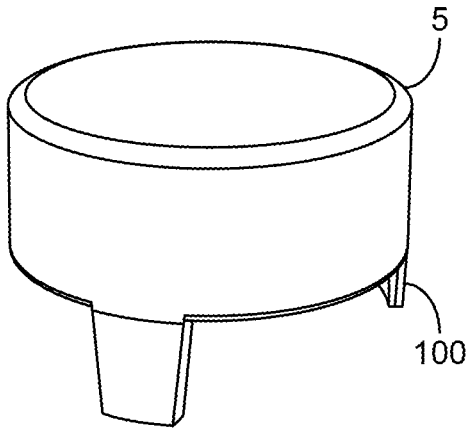
Figure 12C:
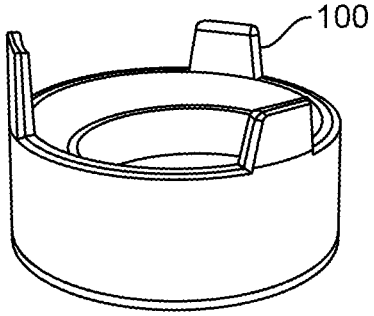
Figure 12D:
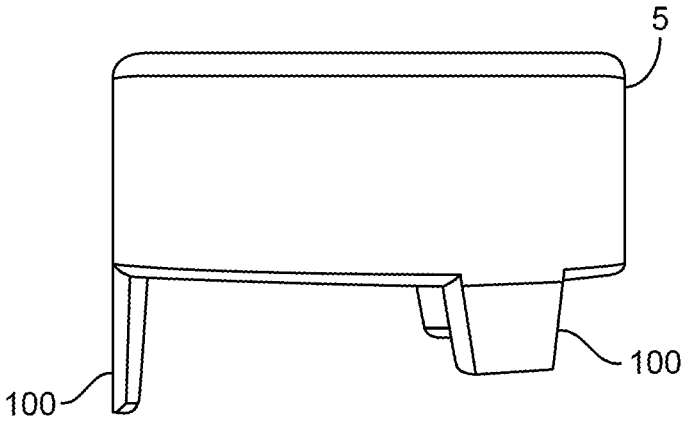

FIGS. 11A and 11B are cut-out views of the cap when not affixed to a can or box. FIG. 11A shows the underside of the cap, with a view of the proportional dimensions of the support band to the outer shell of the cap. This figures, as well as FIG. 11B show that the band does not, in one embodiment, completely encircle the can. In this embodiment, also shown in FIG. 8, the band possess a gap (e.g., a one and one quarter inch gap as shown in FIG. 8 that when the cap is on the can, functions as a connection point or meeting point for the inner support band. Similar to FIG. 11A, FIG. 12A shows an underside view of the cap when not placed on the can. As shown, there is a gap between the band and the outer shell that allows for a secure placement of the cap on the can.

FIG. 13 shows an alternative embodiment and view of the cap of this disclosure. In this Figure, the cap is shown in inside-out view (the interior of the cap that is located up against or contiguous to the can or box when affixed to the can or box.

The cap or lid 5 of this disclosure is a synthetic (e.g., a silicone rubber) beverage cap that can be applied to the top cylinder area of a beverage can 50 or top area of a beverage box 50 by covering the mouth area of the beverage can or box 40 for protection from elements such as water, dirt, and insects. To be applied, the user pulls down on the one or more tabs 100 (e.g., one three tabs 100, in FIGS. 1 to 13) provided with the cap 5 over the top area of a beverage can 10 or box 11. Making sure the open mouth 40 of the beverage can 5 lines up with the open mouth area of the cap or in the flipped open position 20. Firmly pull down the one tab (FIG. 13) or center and back tabs 100 until cap 5 (e.g., silicone rubber) is flush with the aluminum lip 30 of beverage can 5. Once ready to consume a beverage, pull up on the center tab 100 and stretch to the reverse side of the beverage can floor 6, placing and resting the center tab 100 on the reverse top 6 of a beverage can 5, opposite from the mouthpiece 40. The silicone-rubber will provide an opening around the mouth of the can for easy consumption. The silicone-rubber "support band" 200 underneath the lip of can 30 is used to keep the cap placed firmly and stable. Once ready to cover the mouth area of beverage can from outside elements, pull center tab 100 from the reverse side of the beverage can 5 and stretch to the center area beneath the lip of the mouthpiece 40. The center tab should be placed beneath the "support band" 200 just below the mouth 40 of a beverage can 5. To remove, gently pull tabs 100 upward until all of the silicone rubber has been released from aluminum beverage can 5.

Focusing on the cap as a protectant that will save the customer money by covering and sealing liquid in a beverage from water, dirt, and insects. The cap of this disclosure is attractive but intended to secure a beverage lid from outside contamination. It can be produced in large quantities and sold individually to the consumer for a very low cost.

Provided herein is a pliable lid for a beverage container, comprising, or consisting essentially of, or consisting of a main body having a first surface or floor 6; a second surface comprising a sidewall 15 and support band 200 substantially perpendicular to the first surface or floor 6; a can receiving recess 300; and one or more tabs 100 extending perpendicular to the main body so as to form a handle to attach the lid or cap 5 to the beverage container 10 or 11.

In one aspect, the lid comprises a pliable synthetic or natural material. In another aspect, the synthetic lid comprises a synthetic polymer or rubber. In a yet further aspect, the natural material comprises rubber. In a further aspect, the second surface comprising the sidewall 15 and support band 300 substantially perpendicular to the first surface or floor 6 is positioned underneath the lip of the can 30 when affixed to the can. In a further aspect, provided herein is a pliable lid and a can or box. In a yet further aspect, further provided herein is a kit comprising a pliable lid as described herein, and optionally instructions for use. In a further aspect, provided herein is one or more beverage cans or boxes and one or more pliable lids as disclosed herein, and optionally, instructions for use.

Embodiments

It is to be understood that while the disclosure has been described in conjunction with the above embodiments, that the foregoing description and examples are intended to illustrate and not limit the scope of the disclosure. Other aspects, advantages and modifications within the scope of the disclosure will be apparent to those skilled in the art to which the disclosure pertains.

Unless otherwise defined, all technical and scientific terms used herein have the same meaning as commonly understood by one of ordinary skill in the art to which this disclosure belongs. All nucleotide sequences provided herein are presented in the 5' to 3' direction.

The embodiments illustratively described herein may suitably be practiced in the absence of any element or elements, limitation or limitations, not specifically disclosed herein. Thus, for example, the terms "comprising," "including," containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the disclosure.

Thus, it should be understood that although the present disclosure has been specifically disclosed by specific embodiments and optional features, modification, improvement and variation of the embodiments therein herein disclosed may be resorted to by those skilled in the art, and that such modifications, improvements and variations are considered to be within the scope of this disclosure. The materials, methods, and examples provided here are representative of particular embodiments, are exemplary, and are not intended as limitations on the scope of the disclosure.

The scoped of the disclosure has been described broadly and generically herein. Each of the narrower species and subgeneric groupings falling within the generic disclosure also form part of the disclosure. This includes the generic description with a proviso or negative limitation removing any subject matter from the genus, regardless of whether or not the excised material is specifically recited herein.

In addition, where features or aspects of the disclosure are described in terms of Markush groups, those skilled in the art will recognize that embodiments of the disclosure may also thereby be described in terms of any individual member or subgroup of members of the Markush group.

What is claimed is:

1. A pliable lid for a beverage container, comprising: a main body having: a first surface, a sidewall, and a support band, the sidewall and support band each perpendicular to the first surface and encasing the beverage container, wherein the sidewall and support band are not concentric; a beverage container receiving recess; one or more tabs extending perpendicular to the first surface so as to form a handle to attach the lid to the beverage container; wherein the support band does not completely encircle the beverage container and comprises a gap configured to connect to the sidewall of the lid.

2. The pliable lid of claim 1, wherein the support band engages a lip area of the beverage container.

3. The pliable lid of claim 1, wherein the lid comprises a pliable synthetic or natural material.

4. The pliable lid of claim 3, wherein the synthetic lid comprises a synthetic polymer or rubber.

5. The pliable lid of claim 3, wherein the natural material comprises rubber.

6. The pliable lid of claim 1, wherein the support band is positioned underneath a lip of the beverage container when affixed to the beverage container.

7. The pliable lid of claim 1, wherein the support band is radially spaced from the sidewall.

8. The pliable lid of claim 1, further comprising one or more perforations located on the surface of the lid.

9. The pliable lid of claim 1, wherein the main body and support band each comprise a silicon rubber material.

10. A beverage container comprising the pliable lid of claim 1.

11. The pliable lid of claim 1, wherein the first surface is parallel to a top of the beverage container and covers a mouth of the beverage container.

12. A kit comprising one or more beverage containers and one or more pliable lids of claim 1.

13. The pliable lid of claim 1, wherein the support band maintains the lid from being removed from the beverage container when the first surface is in an open position.

14. The pliable lid of claim 1, wherein the support band does not completely encircle a circumference of the beverage container and wherein the gap extends the entire height of the support band.

15. A pliable lid for a beverage container, comprising:

a floor portion parallel to a top of the beverage container configured to move from a closed position to an open position relative to the beverage container;

a sidewall extending perpendicular to the floor portion of the lid and partially encasing the beverage container when the floor portion is in the open position;

one or more tabs extending from and contiguous with the sidewall;

a support band perpendicular to the floor portion and encasing the beverage container around a lip area of the beverage container, the support band configured to engage a lip area of the beverage container when the floor portion is in the open position and when the floor portion is in the closed position; and wherein the support band does not completely encircle the beverage container and comprises a gap configured to connect to the sidewall of the lid.

16. The pliable lid of claim 15, wherein the sidewall is contiguous with the floor portion of the lid.

17. The pliable lid of claim 15, wherein the support band is radially spaced from the sidewall and maintains the lid from being removed from the beverage container when the floor portion is in an open position.

18. The pliable lid of claim 15, wherein the floor portion, at least one of the one or more tabs, and the sidewall are each placed on a reversed side of the beverage container when the floor portion is moved to an open position.

19. The pliable lid of claim 15, wherein the floor portion, the sidewall, the one or more tabs, and the support band each comprise a silicone rubber material.

* * * * *